US005257584A

United States Patent [19]

Pastor

[11] Patent Number: 5,257,584

[45] Date of Patent: Nov. 2, 1993

[54] AFFIXABLE PORTABLE MINI-SAFE

[76] Inventor: Pascal Pastor, Espace Commercial de Fréjorgues, Rue Georges Guynemer, 34 130 Mauguio, France

[21] Appl. No.: 892,953

[22] Filed: Jun. 3, 1992

[30] Foreign Application Priority Data

Jun. 6, 1991 [ES] Spain ..... 9101791
Apr. 27, 1992 [ES] Spain ..... 9201344

[51] Int. Cl.[5] ..... E05G 1/04; E05D 15/56

[52] U.S. Cl. ..... 109/51; 109/59 R; 109/72

[58] Field of Search ..... 109/45, 49, 50, 51, 109/52, 59 R, 59 T, 71, 72

[56] References Cited

U.S. PATENT DOCUMENTS

| | | | |
|---|---|---|---|
| 1,837,501 | 12/1931 | Sunnes | 109/51 |
| 2,791,976 | 5/1957 | Kruschwitz | 109/52 |
| 2,935,955 | 5/1960 | Mann, Jr. | 109/50 X |
| 4,029,370 | 6/1977 | Ziegel et al. | 109/51 X |
| 4,457,240 | 7/1984 | Hungerford | 109/72 X |

FOREIGN PATENT DOCUMENTS

| | | | |
|---|---|---|---|
| 3740960 | 6/1989 | Fed. Rep. of Germany | 109/50 |

*Primary Examiner*—Neill R. Wilson

*Attorney, Agent, or Firm*—Jacobson, Price, Holman & Stern

[57] ABSTRACT

A portable mini-safe for mounting on a surface includes a base plate (30) having a central dish-shaped portion forming a recess (33), fastener holes (35), and a peripheral turned up rim (31), a part spherical hollow cylindrical safe body (32) for receiving goods to be stored, a base plate (11) on the safe body having a central recess portion and a peripheral ring element (13) of resilient material for engaging against the mounting plate when installed with the peripheral edge of the safe body engaged within the upturned rim (31) of the mounting plate. A dome shaped cover (1) engages over the open end of the safe body and has peripheral tabs (3) engageable in bayonet slots (7, 3) when the cover is installed. The rotatable camming element (23) is mounted within the safe body for drawing the base plate and mounting plate together for installing the safe on a surface. Bramah locks (9) are provided on the safe body for operating a locking latch (10) to retain tabs (3) in bayonet slots (8) in the locking position to prevent opening of the safe.

2 Claims, 3 Drawing Sheets

AFFIXABLE PORTABLE MINI-SAFE

FIELD OF THE INVENTION

This invention relates to a small, portable container to serve as a small safe to be placed on a table or vertical surface and which has interior mechanisms which secure it strongly to the surface on which it is placed so that it cannot be removed without operating the internal mechanisms. Outside, On the top, there is a cover or lid, suitably fitted, and secured to the box forming the container by means of a lock with several fixing points. The structural and design features are significantly different from all similar existing safes so that, along with the qualities of novelty and practical utility, it is felt to have sufficient base for the granting of the exclusive privilege sought.

SUMMARY OF THE INVENTION

The portable mini-safe of this invention is made up of two fundamental parts, one formed by the box or container as such and the other by the closing cover. In plan view the container is circular and has the form of a part spherical hollow cylinder. One or more bramah locks are provided in the wall of the container to close the cover. The upper open end of the wall has a step or depression and, at several equidistant points on the stepped projection, there are vertical notches each connected to a further horizontal notch to form bayonet type hooks. The cover, in the shape of a spherical segment has, on the inside edge, a strip secured to it with a number of protruding tabs engageable in the bayonet notches to secure and fasten the cover to the cylinder member of the safe.

To fasten the mini-safe on the surface where it is to be placed, there is an elastic element on the outside of the bottom, around the periphery, made of rubber or a similar product formed by a number of concentric peripheral protrusions which act as a suction cup on the surface: to enhance the suction function as much as possible, outside, on the central bottom, a component is included adjacent to a depression in the bottom, comprising a metal disc covered in rubber which, when forced upwards by an eccentric lever on the central axis of the rubber-covered metal bottom, generates a vacuum to consolidate the fastening.

In another embodiment of the invention, the portable mini- sgafe with components for securing it on a horizontal or vertical surface, even though such surface be porous or rough, so as to provide a small safe, is fastened onto a smooth non-porous surface using elastic elements of rubber or the like and mechanisms forming a suction cup or internal depression to create a vacuum to consolidate the fastening process. To enhance this fastening or fitting process on surfaces where such a vacuum is not possible, the base of the mini-safe incorporates a supplementary element in the shape of a bowl screwed to the surface on which the safe is to be used and is fastened to the mini-safe by a central shaft which can be moved by an internal mechanism so as to form a unit with the assembly as a whole.

Essentially, the affixable portable mini-safe of this second design has a strip base with an upwardly protruding peripheral rib overlapping around the base of the mini-safe. In the center, there is an upwardly extending circular recess with an opening in the middle through which the central fixing shaft or bar can pass. On several points of the surface of the strip base there are equidistant holes through which screws extend to fasten it onto the surface to be used.

Inside the central circular recess, a disc is placed on the lower surface, preferably made of metal. In the center, rivetted or otherwise fitted to the disc, there is a vertical shaft or bar which extends through an opening in the base plate and which fits inside the mini-safe. Through the inner part of the shaft or bar, there is a diametric hole containing a pin for pivotally connecting an operating lever to an eccentric point, so that once the base is fastened to the surface to be used, and the central shaft or bar is fitted inside the mini-safe, the eccentric lever is operated and the mini-safe is completely secured to the base itself.

BRIEF DESCRIPTION OF THE DRAWING

The invention will now be described in detail with reference to the accompanying drawings of the two practical designs for this affixable portable mini-safe and wherein.

DETAILED DESCRIPTION

Figure 1:
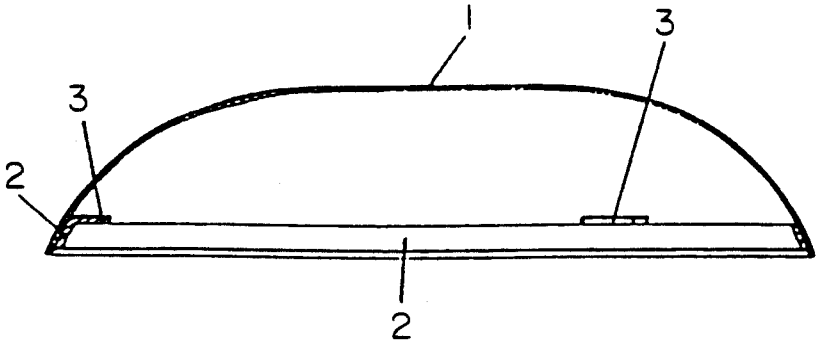
FIG. 1 is a diametral cross-section of the cover or lid, inside which, on the periphery, a strip or plate is secured having at several places horizontal protruding tabs with which to close the safe by the cover.
Figure 2:
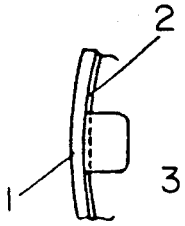
FIG. 2 is a detail plan view of one of the curved closing tabs or protrusions fixed on the inside of the cover.
Figure 3:
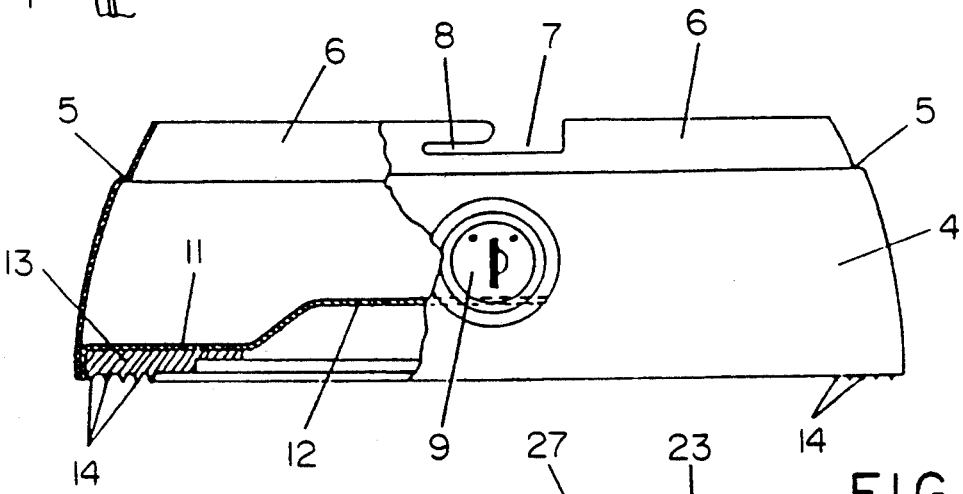
FIG. 3 is a front elevation with a partial cross-section of the safe, showing the bramah lock and upper notch for securing the cover, the cross-sectioned area showing the strip base section with the central depression and the rubber ring with the sharp concentric protrusions which provide the suction cup action.
Figure 6:
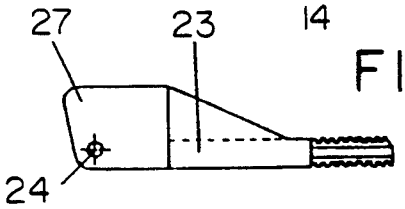
FIG. 6 is an elevational lengthwise view of the eccentric lever which lifts the component providing the vacuum.
Figure 5:
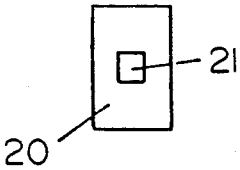
FIG. 5 is a plan view of the recovery spring stop plate.
Figure 7:
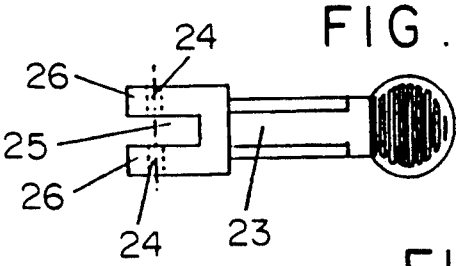
FIG. 7 is a top view of the eccentric lever of FIG. 6.
Figure 4:
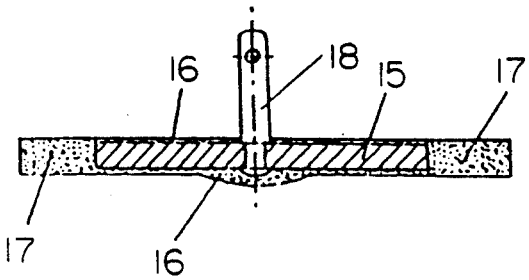
FIG. 4 is a diametral cross-section of the inside element which moves vertically to provide the vacuum, comprising a metallic central component covered in rubber to provide a hermetic seal and at the top, a central shaft or rod emerges which is operated by an eccentric lever.
Figure 8:
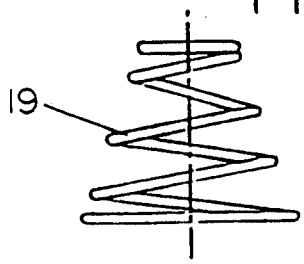
FIG. 8 is an elevation of the tension spring which recovers the movable element that forms the vacuum, fitted between the element and the stop plate.
Figure 9:
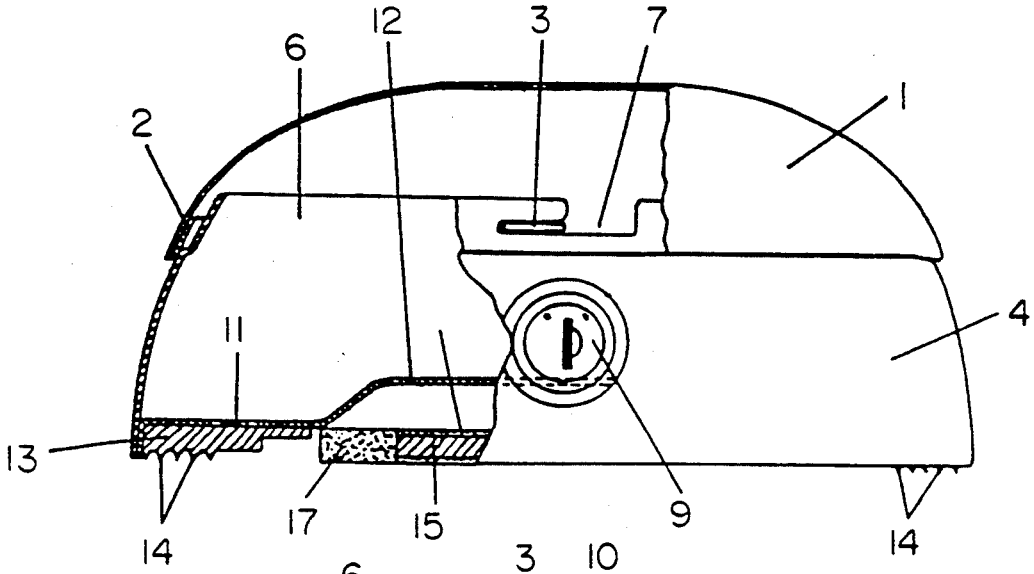
FIG. 9 is a front elevation with a partial cross-section of the mini-safe in position, at the initial closing stage, showing how the tabs on the cover or lid are arranged inside the bayonet notches of the offset upper rim portion of the cylinder.

At all times with reference to the attached drawings, it is to be noted that the figures include numerical indications related to the following description of the features and operation so as to facilitate their immediate location. The element marked 1 is the safe's cover or lid having the outside shape of a spherical segment and which alongside the fitting edge, a peripheral strip 2 is welded or otherwise fixed to it and from which curved horizontal tabs 3 protrude facing inwards, equidistant from each other, and which provide the means to secure the cover to the safe.

The safe itself is made up of a spherical disc element which has a recess 5 in the top leading to the protruding peripheral rib 6 in which, equally spaced, are the vertical grooves 7 in the form of openings, followed by the squared notch 8 which forms bayonet-shaped housings with which to fit and secure the cover or lid 1. For these purposes, at one or more points on its periphery, the safe 4 has bramah locks 9 which, once operated, place the latch 10 alongside the vertical groove marked 7 making it impossible for tab 3 to move inside the notch 8, thereby keeping the cover firmly closed.

To secure the safe 4 to a smooth non-porous support surface, fixed to the bottom there is a base-plate 11 with a depression 12 in the center, whose sides are in the form of a truncated cone. Close to the periphery and on the outside surface of base plate 11 there is a ring made of rubber or similar material 13 which has sharp concentric protrusions 14 as support points with which to affix the safe to a smooth surface with a suction cap and internal depression. This depression or vacuum is obtained with the bottom centered disc which consists of a rigid body or core 15 made of metal and covered with a rubber mass 16, with flexible, elastic side blocks 17. The metallic internal body 15 carries the rising central shaft 18 that runs through the center of the bottom plate 11 and depression 12. The part protruding into the interior of the safe 4 has the pressure spring 19 around it which presses at the bottom on the vacuum element while, at the top, it rests on the plate 20 with the square opening 21 through which the square upward central shaft 18 runs.

Figure 10:
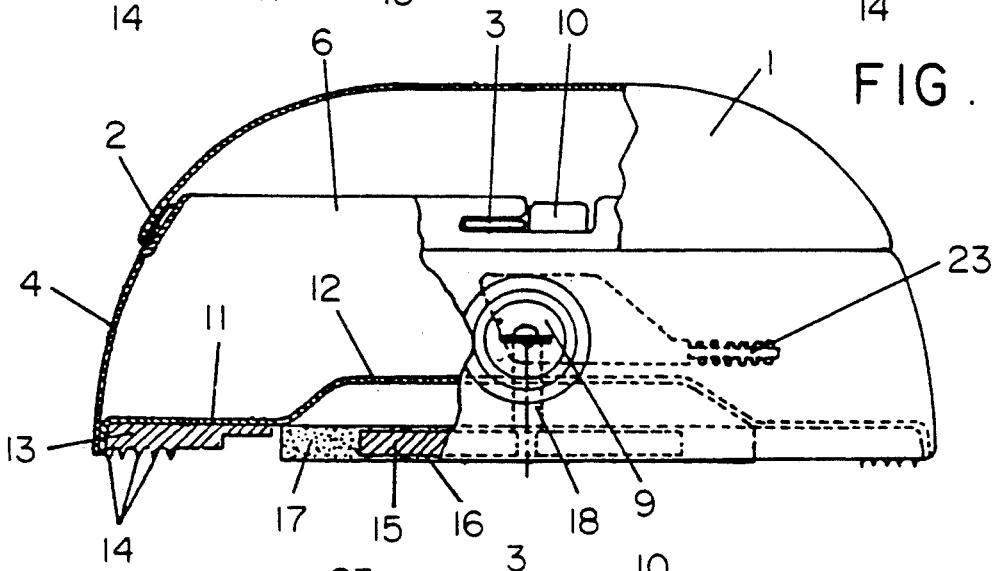
FIG. 10 is a view similar to FIG. 9, showing operation of the lock whereby the latch closes off the cover securing plate and showing the operating lever at the rest position in which the bottom vacuum-generating element can be moved.
Figure 11:
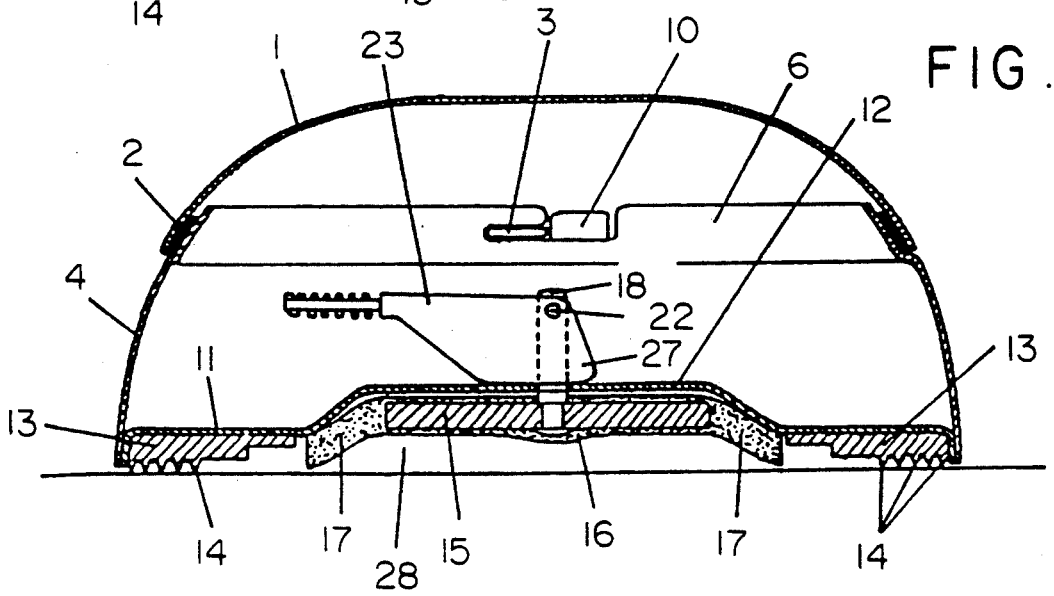
FIG. 11 is a general diametral cross-section of the assembly once in place, showing that the inside lever has been operated and, because of its eccentric shape, it has lifted the bottom element to form a vacuum chamber which secures the safe onto its supporting surface.
Figure 12:
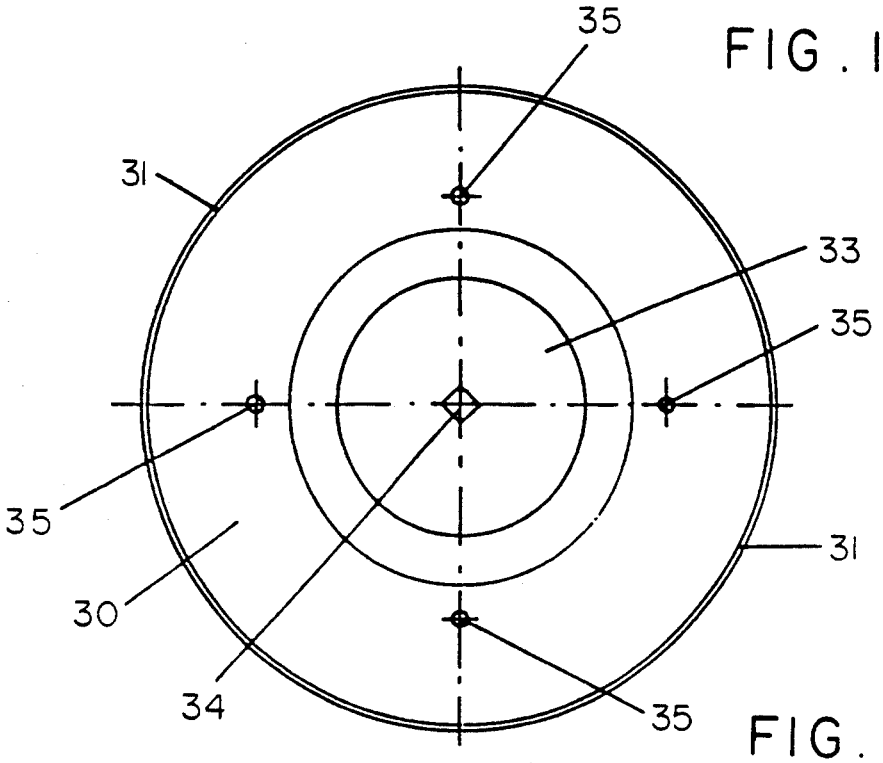
FIG. 12 is a top plan view of the base plate of a second embodiment of the invention which affixes the mini-safe to a surface, with the peripheral rib for overlapping around the mini-safe, the central protrusion with the central opening and the peripheral spaced holes for the screws.
Figure 13:
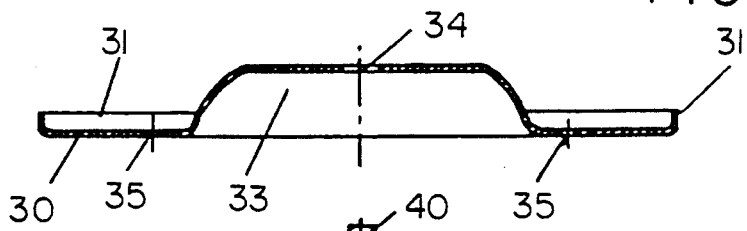
FIG. 13 is a diametral cross-section of the base plate in FIG. 12.
Figure 14:
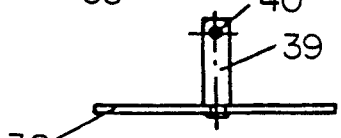
FIG. 14 is an elevation view of the element used in the bottom cavity of the base plate in the second embodiment, formed by a disc, preferably made of metal, and a rising vertical bar or shaft attached to the disc.
Figure 15:
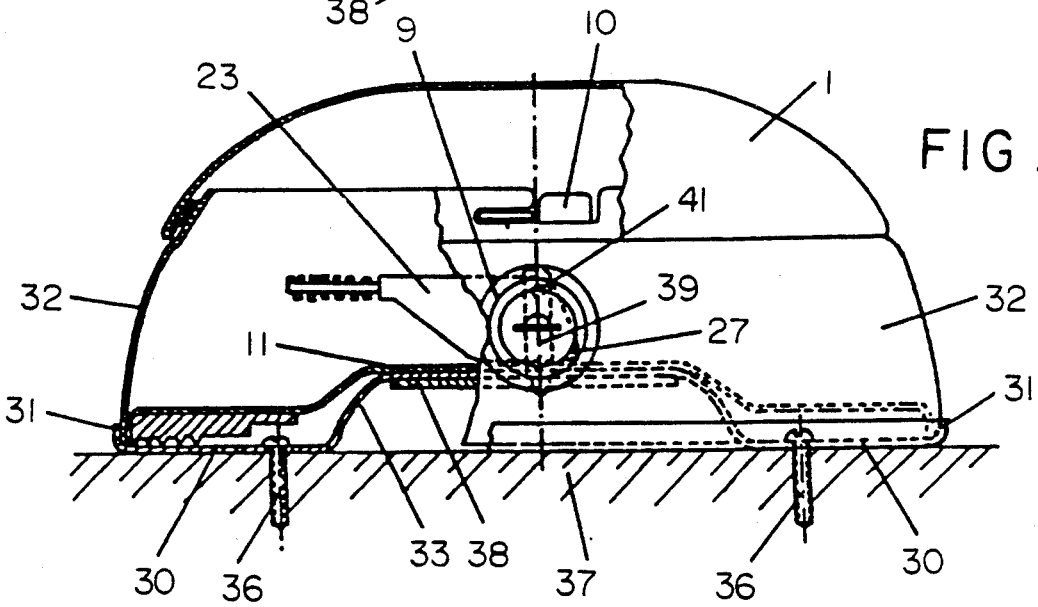
FIG. 15 is a view similar to FIG. 10 of the second embodiment showing a mini-safe fitted on the base plate which is in turn mounted on the surface where the mini-safe is to be affixed.

At the top end of the rising central shaft 18 is the diametral pin 22 providing the articulated fitting for the cam operating lever 23 at the eccentric point or hole 24, after it has passed through the plate 20. The end of the shaft 18 fits inside the cavity 25 between the wings 26 of the lever 23. Because of the eccentric position of hole 24 in part 27 of the lever, in the position in FIG. 11, there is an upward pull on shaft 18 when the lever 23 is rotated so that the metal body 15 is drawn into depression 12 on the base plate 11 and the rubber side blocks 17 resting on the truncated cone sides of depression 12 curve inwards and hermetically seal off any input of air, thereby generating a vacuum in the chamber 28 which firmly affixes the safe to its support surface in such a way that it cannot be removed until the operating lever 23 is returned to its rest position, as shown in FIG. 10.

In the second embodiment shown in FIG. 12, 13, 14 and 15, the circular strip base mounting plate 30 has an upward extending peripheral rib 31 for overlapping around the body 32 of the mini-safe: in the center, there is a raised cavity 33 formed upward from the base, the middle of which has a rectangular opening 34 through it and, at a number of equidistant points, holes 35 through which it can be fastened to the surface 37 with the base plate 30 fixed to surface 37 with the screws 36 before the mini-safe is put in place.

The disc 38 preferably made of metal is placed inside cavity 33 and has in the center prismatic bar or rod 39 that fits through the central opening 34 and which, in turn, runs through the base plate 11 of the mini-safe 4. Through the opening 40, a pin 41 extends to secure bar 34 to the operating lever 23 which, because of the eccentric design provides an upward pull as described above in the description of the operation of spring 19, so that the disc 38 rises until it is adjacent to the bottom of cavity 33, thereby securing the assembly in place.

The general body 32 of the mini-safe incorporates one or more bramah locks 9 to lock cover 1, in the form of a bayonet, with latch 10. In general, it has the same components and fittings as the design shown in FIGS. 1–11.

Following a full description of each and every one of the parts making up the affixable portable mini-safe which is the subject of this invention, it remains only to be said that the different parts may be manufactured in a variety of materials, sizes and shapes, and the design may incorporate variations of construction which experience may suggest, provided that these do not alter the essential points which are the subject of the following claims.

I claim:

1. An affixable portable mini-safe comprising:

a base plate having a peripheral outer edge portion and a central portion;

an inverted dish-shaped configuration in said central portion to form a recess in the lower side of said base plate, said lower side facing a surface on which said safe is connected when in use;

a substantially cylindrical wall portion extending upwardly from said peripheral portion of said base plate to form a hollow interior chamber for storage of goods;

an upper edge portion on said substantially cylindrical wall portion to form an open upper end thereon;

a plurality of bayonet-shaped notches in said upper edge portion, each having an upwardly open tab receiving notch and a bayonet slot extending therefrom;

a removable inverted dish-shaped cover having a peripheral rim portion engageable around said substantially cylindrical wall portion adjacent said upper edge portion thereof;

a plurality of tabs protruding inwardly from said peripheral edge portion of said cover and engageable with said tab receiving notches and said bayonet slots so that when said cover is installed on said substantially cylindrical wall portion said locking tabs are positioned within said tab receiving notches and rotation of said cover in one direction inserts said tabs into said bayonet slots;

at least one locking means in said substantially cylindrical wall portion comprising a rotatable latch means rotatable from an unlocking position into a locking position adjacent one of said tab receiving notches and engageable by one of said tabs in one of said bayonet slots for retaining said tabs in said bayonet;

a substantially circular mounting plate having an outer peripheral portion and a central inverted dish-shaped portion engageable in said recess in said base plate when installed;

aligned rectangular openings through said central portions of said base plate and said mounting plate;

a plurality of circumferentially spaced holes through said mounting plate between said outer peripheral portion and said central portion for receiving screw fasteners therethrough for fastening said mounting plate to the surface on which said safe is mounted;

an upwardly extending peripheral rib on said outer peripheral portion of said mounting plate engageable around said outer peripheral edge portion of said base plate and said substantially cylindrical wall portion connected thereto; and means engageable with said central portions of said base plate and mounting plate for resiliently urging said base plate and mounting plate together for retaining said safe on said mounting plate.

2. The portable mini-safe as claimed in claim 1 wherein said means for resiliently urging said base plate and said mounting plate together comprises:

a disk member engageable in said central inverted dish-shaped portion of said mounting plate and having a prismatic rod extending therefrom through said aligned rectangular openings in said mounting plate and base plate and having an inner end on said rod protruding into said chamber;

a camming lever pivotally mounted eccentrically on said rod and having a camming surface engaging said central portion of said base plate on the side thereof in said chamber, so that rotation of said camming lever from a release position where said central portions of said mounting plate and base plate are not urged together to a fixed position where said prismatic rod is drawn into said chamber and said disk member is drawn into tight engagement against said central portion of said mounting plate for urging said mounting plate and said base plate toward each other into tight fitting engagement.

* * * * *